United States Patent [19]

Nowakowski et al.

[11] Patent Number: 4,803,980

[45] Date of Patent: Feb. 14, 1989

[54] AUTOMATIC BREATHING MASK RELEASE MECHANISM

[75] Inventors: Donald E. Nowakowski; Carlton W. Naab, both of Safety Harbor, Fla.

[73] Assignee: Conax Florida Corporation, St. Petersburg, Fla.

[21] Appl. No.: 922,075

[22] Filed: Oct. 20, 1986

[51] Int. Cl.[4] ..... A62B 17/04; B63C 11/02; A42B 3/00

[52] U.S. Cl. ..... 128/201.23; 2/6; 2/422; 24/602; 128/202.27

[58] Field of Search ..... 24/602, 603; 2/2.1 A, 2/2.5, 6, 173, 421, 422, 424; 128/201.23, 201.24, 202.11, 202.27; 361/251

[56] References Cited

U.S. PATENT DOCUMENTS

| | | | |
|---|---|---|---|
| 2,867,812 | 1/1959 | Roth et al. | 2/6 |
| 3,035,573 | 5/1962 | Morton, Jr. et al. | 128/201.23 |
| 3,123,831 | 3/1964 | Wells et al. | 128/201.23 X |
| 3,473,166 | 10/1969 | Lobelle | 128/201.24 X |
| 3,872,556 | 3/1975 | Frost | 24/603 |
| 4,024,440 | 5/1977 | Miller | 361/251 |
| 4,086,685 | 5/1978 | Gaylord | 24/603 X |
| 4,447,084 | 5/1984 | Jankowiak et al. | 24/603 X |
| 4,488,546 | 12/1984 | Bernhardt et al. | 128/201.23 |
| 4,513,248 | 4/1985 | Miller | 361/251 X |
| 4,637,101 | 1/1987 | Fiedler | 24/602 |
| 4,689,834 | 9/1987 | McCarthy et al. | 2/6 X |

FOREIGN PATENT DOCUMENTS

| | | | |
|---|---|---|---|
| 2414339 | 9/1979 | France | 24/602 |

*Primary Examiner*—Wm. Carter Reynolds
*Attorney, Agent, or Firm*—Christel, Bean & Linihan

[57] ABSTRACT

Apparatus for separating a breathing mask from a helmet automatically upon the occurrence of a predetermined event, the mask having a bayonet connection to a bayonet receiver carried by the helmet. A piston and an explosive cartridge are arranged in an actuator body associated with the bayonet receiver. Upon the occurrence of the predetermined event, as sensed by an activating circuit associated with the receiver, the explosive cartridge generates a shock wave driving the piston against the bayonet in generally right angular relation to the bayonet, thereby forcibly separating the bayonet from the receiver.

30 Claims, 2 Drawing Sheets

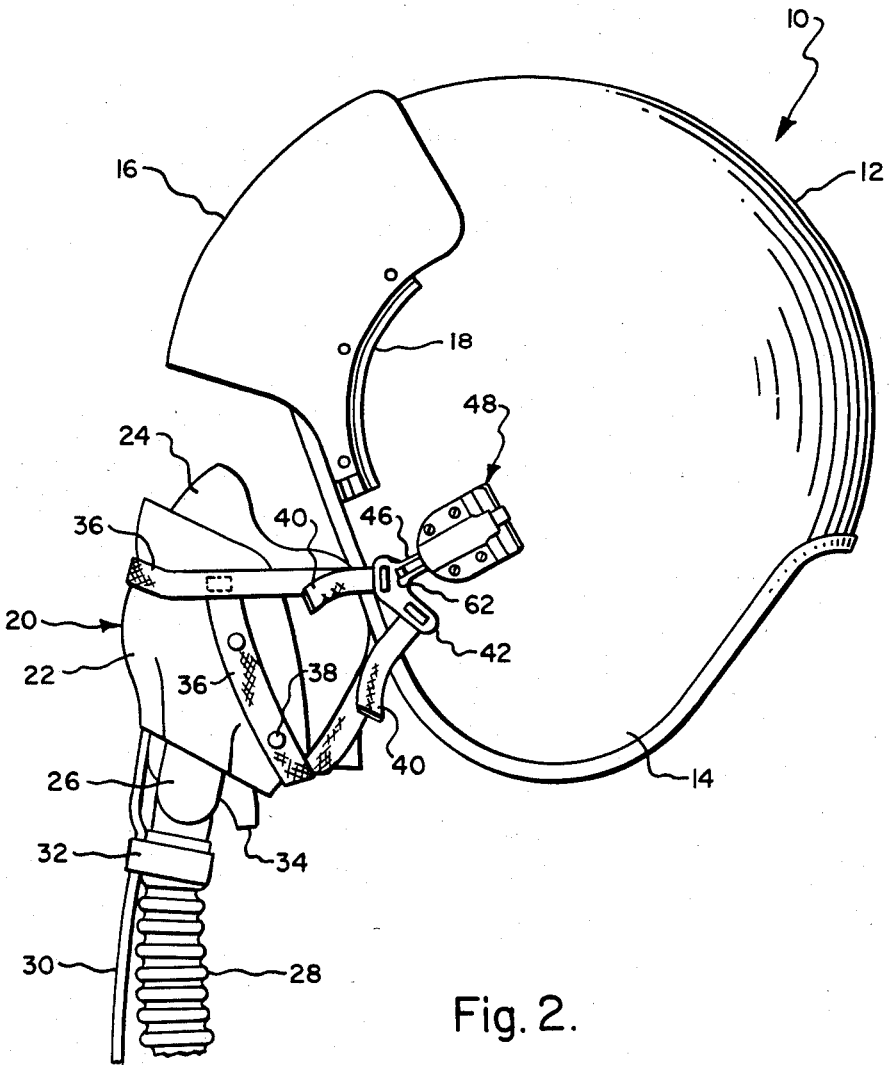
Fig. 1.
Fig. 2.
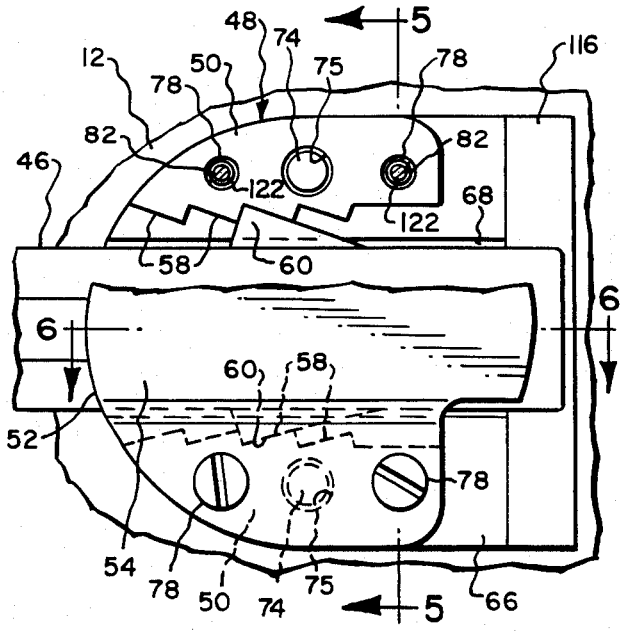
Fig. 3.
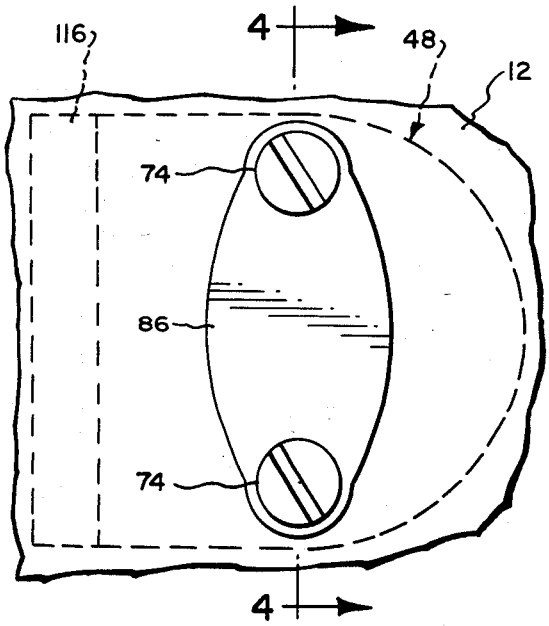

AUTOMATIC BREATHING MASK RELEASE MECHANISM

BACKGROUND OF THE INVENTION

This invention relates to an explosively actuated mechanism automatically operable upon the occurrence of a predetermined event to ensure the release of a breathing mask from a protective helmet sufficiently to enable the user to breathe the ambient atmosphere independently of the mask.

Pilots and other aircraft crew members customarily are provided with breathing mask-protective helmet arrangements wherein the mask is releasably secured to the helmet in a manner positioning the mask snugly against the face of the user. Typically, such arrangements include a mask mounting harness terminating at opposite ends in bayonets which are engageable in bayonet receivers mounted on opposite sides of the helmet and having channels for receiving the bayonets. Such arrangements typically include spring fingers carried by the bayonets which engage the teeth of opposed jaw members mounted in the receivers on opposite sides of the channels, the arrangement permitting the aviator to push the bayonets into the bayonet receiving channels until the mask fits comfortably snugly against the user's face, and serving to lock the mask in such position of use. The bayonets are provided with manually actuated release mechanisms, so that the aviator can release the bayonets from the helmet mounted receivers when he wishes to remove the mask from its position of use against his face.

Breathing gas is supplied to the interior of the mask through a hose connected to one end to the mask and having its other end connected through a quick disconnect coupling to a source of breathing fluid carried by the aircraft. Upon ejection of the aviator from the aircraft, the hose is released from its source connection, remaining attached to the mask as the aviator descends. This presents a potential problem if the aviator descends into water, because of the need to separate the mask from the face of the man. While the manual release mechanism presumably will remain operative, often the aviator will be unconscious or injured and unable to manually release the mask. In that event, he can breath only through the mask, and will inhale water and shortly drown if the mask remains secured against his face.

Accordingly, a primary object of the present invention is to provide an arrangement automatically operable to ensure separation of the mask from the helmet, to a degree sufficient to permit the wearer to breath the ambient atmosphere independently of the mask, upon the occurrence of a predetermined event such as the presence of water.

Another important object of this invention is to accomplish the foregoing in a manner requiring minimal modification of mask mounting arrangements currently in use, thereby enabling retrofitting of existing mask-helmet assemblies and permitting the use of masks and helmets of existing, approved design.

Still another object of this invention is to provide the foregoing in a relatively simple, highly dependable arrangement which is totally compatible with the environment of its intended use.

SUMMARY OF THE INVENTION

Briefly stated, in one aspect of the present invention an automatic release mechanism is incorporated in the helmet mounted bayonet receiver in a manner such as to permit the continued use of conventional mask mounting bayonet arrangements. The mechanism includes jaw members which can be of conventional design and are adapted to engage a conventional mask mounting bayonet in a manner permitting manual connection and release of a conventional mask harness in the usual manner. A piston and an explosive cartridge are part of the automatic release mechanism, the piston being arranged at generally a right angle to the longitudinal axis of the bayonet receiving channel. The piston is impelled against the bayonet by the inertial shock wave generated by the explosive cartridge, driving the bayonet outwardly beyond the jaw members in a manner ensuring separation of the bayonet from its receiver. The explosive cartridge is activated automatically in response to the occurrence of a predetermined event, such as exposure to a body of water. Thus the automatic release mechanism operates independently of the manual release mechanism associated with the receiver.

BRIEF DESCRIPTION OF THE DRAWING FIGURES

FIG. 1 is an elevational view showing a conventional breathing mask connected to an aviator's helmet in a manner positioning the mask against the face of the user (not shown), the helmet incorporating an automatic mask releasing mechanism of this invention;

FIG. 2 is a fragmentary elevational view of the bayonet receiver and automatic release mechanism illustrated in FIG. 1, taken about on line 2—2 of FIG. 4 on an enlarged scale and with a portion of the cover plate broken away;

FIG. 3 is an elevational view of the bayonet receiver mounting arrangement, as seen from within the helmet, taken about on line 3—3 of FIG. 4;

DETAILED DESCRIPTION OF THE ILLUSTRATED EMBODIMENT

Figure 4:
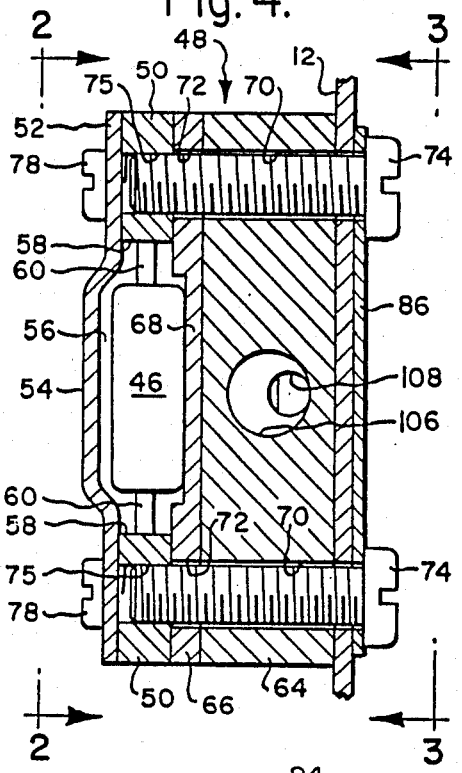
FIG. 4 is a transverse sectional view of the bayonet receiver and automatic release mechanism, taken about on line 4—4 of FIG. 3.
Figure 5:
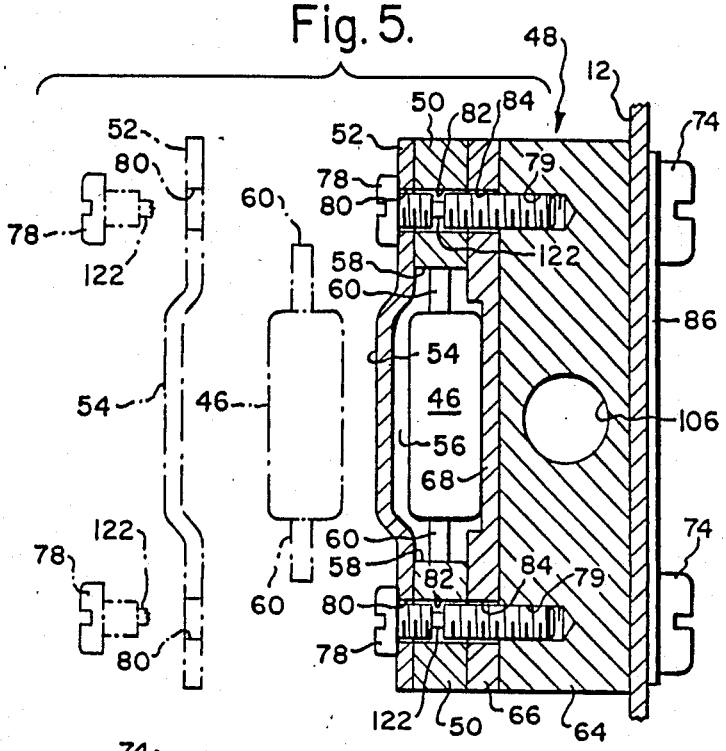
FIG. 5 is a transverse sectional view thereof taken about on line 5—5 of FIG. 2, with the separated bayonet and cover plate being indicated in phantom.

FIG. 1 illustrates an automatic release mechanism of this invention shown in conjunction with a helmet mounted receiver for a bayonet connector of an aviator's breathing mask. The helmet, generally designated 10, comprises a shell 12, an ear cover portion 14 on each side and a cover 16 for a visor (not shown) movable on a track 18 to and from a retracted position beneath cover 16. The breathing mask, generally designated 20, comprises a body 22 shaped to fit over the mouth and nose of the aviator's face and includes a nosepiece formation 24 in the upper region of body 22 as viewed in FIG. 1 and an inlet formation 26 in the lower region thereof. Inlet 26 is in fluid communication with one end of a hose 28 for supplying breathing gas to the interior of mask 20.

Normally, hose 28 is connected at its other end through a quick disconnect coupling (not shown) to a source of breathing gas in the aircraft, such as a tank (not shown). When the pilot is ejected from the aircraft during an emergency, the end of hose 28 is disconnected from the tank, and the length of hose 28 remains connected at its other end to mask 20 and travels with the pilot as he descends by parachute. A cable 30 connected to hose 28 by a clamp 32 leads at one end into mask 20 and comprises a plurality of conductors for electrical connection to a microphone (not shown) in mask 20 and earphone (not shown) in helmet 10. The other end of cable 30 normally is connected to communications equipment in the aircraft and is disconnected therefrom when the pilot ejects and travels with him during descent by parachute. The mask also includes an exhaust outlet 34 in the lower portion thereof which is provided with a check valve (not shown) through which the pilot expels air.

Mask 20 is releasably connected to helmet 10 in the following manner. Mask body 22 is received in a harness comprising straps 36 which are secured to body 22 by fasteners 38. On each side of the mask, straps 36 terminate in two free ends 40 which are looped through or otherwise connected in corresponding slots near opposite ends of a transverse arm or bar formation 42 at one end of a bayonet finger or connector 46. The other end of bayonet 46 is releasably engaged in a bayonet receiver, generally designated 48, mounted on the exterior surface of helmet shell 12 near the front and upwardly of the ear covering portion 14 thereof. Receiver 48 incorporates an automatic release mechanism of this invention, as described hereafter.

On the side of mask 20 and helmet 10 not shown in FIG. 1 there is provided a similar arrangement of strap ends 40 connected to a transverse arm at one end of a bayonet corresponding to that shown at 46, engaged in a receiver mounted on the exterior surface of helmet shell 12 and having a bayonet engaging portion like that shown at 48. However, an automatic release mechanism of this invention need be incorporated in only the one bayonet receiver, shown at 48, and the bayonet receiver on the opposite side of helmet 10 (not shown) can be of conventional design. Each of the bayonet receivers posseses a relatively low and similarly-shaped profile as helmet 10 is viewed frontally.

As shown in FIG. 2, bayonet receiver 48 includes a pair of opposed jaw members 50 positioned beneath a cover plate 52 having a raised central portion 54 defining, with the opposed jaw members 50, a bayonet receiving channel 56 shown in FIG. 4. Jaw members 50 have a series of teeth 58 extending along channel 56 and adapted to be engaged by spring loaded ears 60 carried by bayonet 46 and normally extending from opposite sides thereof.

In practice, the pilot manually pushes bayonets 46 into the channels 56 of receivers 48, on opposite sides of the helmet, until the mask 20 is snugly positioned against this face. When the pilot wishes to release the mask from its position of use against his face he grasps the turned end 62 of a lever carried by bayonet 46 and pushes it forwardly, toward the mask, the bayonet typically having an internal wedging mechanism (not shown) for retracting ears 60 when this is done. An arrangement of this general type is shown in U.S. Pat. No. 3,035,573 issued May 22, 1962. Such arrangements being conventional and well understood in the art, further description and discussion of them is believed unnecessary.

The mask and its attaching harness including bayonets 46 are conventional, as are cover plate 52 and jaw members 50, and the standard bayonet receiver on the opposite side of 10 helmet will have jaw members 50 and a channel-defining cover plate identical to that shown at 52 for receiving the other bayonet 46. However, receiver 48 on the illustrated side of helmet 20 is provided with an automatic release mechanism of this invention, while the receiver on the opposite side of helmet 10 is not.

Referring now to FIGS. 2–7, there is shown an automatic release mechanism of this invention incorporated in receiver 48 and comprising an actuator body 64 positioned beneath cover plate 52 and jaws 50, being separated from the latter by a spacer plate 66 which, in conjunction with jaw members 50 and cover plate 52 completes the definition of the bayonet receiving passageway or channel 56. Spacer plate 66 is formed with a central channel portion 68 arranged in opposition to the raised portion 54 of cover plate 52 and alined therewith lengthwise of channel 56.

Actuator body 64 and spacer plate 66 have alined clearance holes 70, 72 therethrough which receive mounting screws 74 extending with threaded bores 75 extending through jaw members 50 generally centrally thereof. Mounting screws 74 thereby secure jaw members 50, spacer plate 66 and actuator body 64 together in assembled relation against shell 12 of helmet 10.

Cover plate 52 is held in position over jaw members 50 by cover mounting screws 78 which extend through clearance holes 80, 82 and 84 through cover plate 52, jaw members 50 and spacer plate 66, respectively into threaded engagement with threaded bores 79 in actuator block 64. A pair of cover mounting screws 78 extend through each jaw member 50 on opposite sides of bayonet channel 56, with the mounting screws 78 of each pair thereof being arranged on opposite sides of the helmet mounting screws 74 in spaced relation axially of the bayonet receiving channel.

Thus, the cover plate 52 is secured in position on the bayonet receiver by the mounting screws 78 threadedly engaging the actuator block 64, with the entire bayonet receiver 48 being mounted on the exterior surface of the helmet shell 12 by the mounting screws 74, the heads of which are inside the helmet and which engage a plate 86 bearing against the inner wall of the helmet shell 12.

The actuator body 64 and spacer plate 66 have the same profile, which is the same profile as cover plate 52 except at the inner end of the latter where it is cut away, as shown in FIG. 2.

It is a particular feature of this invention that the automatic release mechanism does not merely release bayonet 46, for example by disengaging ears 60 from jaw teeth 58, thereby permitting bayonet 46 to slide out of receiver 48. Such a passive arrangement would have the disadvantage that it would not insure separation sufficient to release the mask 20 from its position against the face of the pilot, and permit the pilot to breath the ambient atmosphere directly, rather than through the mask tube 28.

Instead, the release mechanism of this invention incorporates means forcibly separating the bayonet 46 from the receiver 48, in a manner insuring such separation and consequent release of the mask 20 from the face of the pilot.

To this end, actuator body 64 is provided with a cylindrical bore 88 the axis of which extends at a right angle to the center line of the bayonet receiving channel 56 and which intersects the longitudinal axis of bayonet 46 at a right angle thereto. Spacer plate 66 has a cylindrical bore 90 therethrough concentric with the actuator body bore 88 out of reduced diameter providing an annular stop shoulder 92 at the outer end of bore 88.

A piston member generally designated 94 is positioned within bore 88, the piston having at one end an enlarged head with a cylindrical section 95 engaging the wall of bore 88 with a press fit, the piston head having a beveled edge 96 at that end, thereby defining a small, annular chamber 98 at the inner end of bore 88. The press or force fit engagement between piston surface 95 and the wall of bore 88 is sufficient to make the chamber 98 essentially gas tight, while permitting movement of the piston 94 axially outwardly of the bore 88 as hereafter described. The other end of piston 94 is a body section 100 of reduced diameter corresponding essentially to the diameter of spacer plate bore 90, while permitting sliding engagement between the body 100 and the wall of bore 90. The reduced diameter body portion 100 provides an annular shoulder 102 at the inner end of the cylindrical wall section 95, the shoulder 102 engaging the shoulder 92 on spacer plate 66 to act as a stop, when the piston is forcibly driven axially outwardly, lengthwise of bore 88.

The driving force for piston 94 is provided by an explosive shock type primer 104 received within a chamber 106 communicating at its inner end with chamber 98 through a passage 108. At its opposite end, chamber 106 is closed by an "O" ring 110 providing gas tight engagement between te actuator body 64 and a plug 112 threadedly engaged within the actuator body 64 at the outer end of chamber 106.

Explosive cartridge 104 can be like the cartridge provided in U.S. Pat. No. 4,024,440, and has a conductor 114 connected to an activated circuit contained within a housing 116 across the end of actuator body 64. The activating circuit, which is not a part of this invention, acts in response to the occurrence of a predetermined event to electrically trigger the explosive cartridge 104, detonating it and thereby generating high pressure gases which pass immediately through passageway 108 into chamber 98 and create an immense inertial shock wave acting upon the piston head. The extremely high pressure of the gas generated by exploding cartridge 104 drives piston 94 with great force from the position shown in FIG. 6 to the position shown in FIG. 7, the gas flow being indicated by the arrows 118.

The cylindrical section of 95 of the piston head is of sufficient axial length to function as a bearing guide, preventing canting or cocking of piston 94 in bore 88 and ensuring axial movement of the piston as intended.

Figure 6:
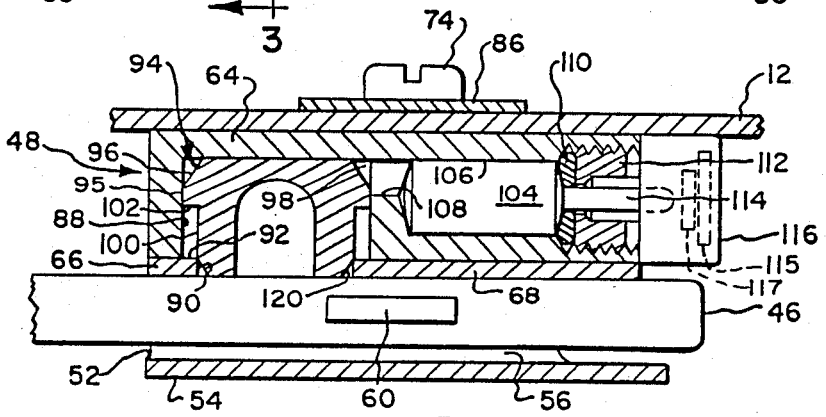
FIG. 6 is a longitudinal sectional view thereof taken about on line 6—6 of FIG. 2.
Figure 7:
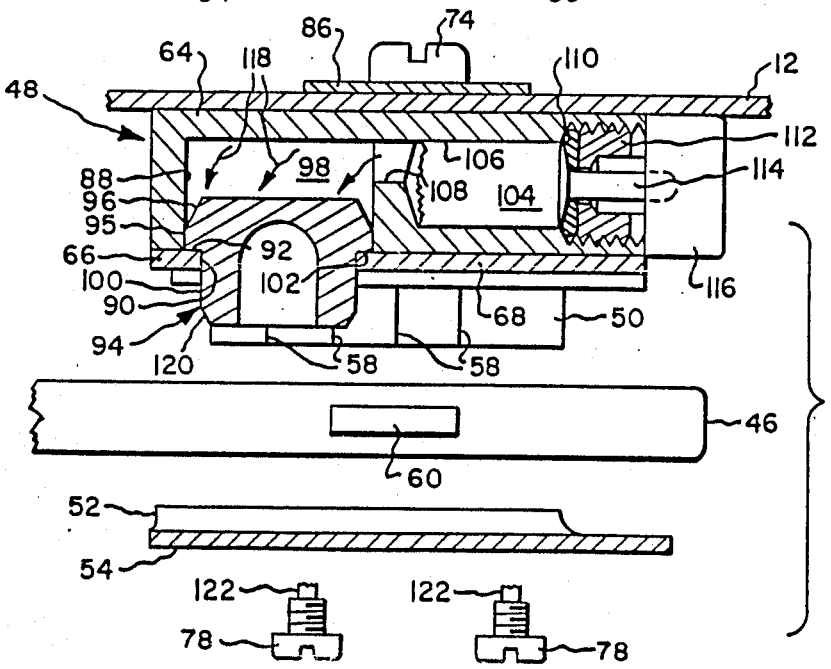
FIG. 7 is a view similar to that of FIG. 6, but illustrating the parts as they appear after the release mechanism has functioned to separate the mask bayonet from the helmet-mounted receiver.

As seen in FIG. 6, when piston 94 is in its initial position of rest, it is aligned with bayonet 46 at right angles to the longitudinal axis thereof. The outer end of piston 94 is beveled, as shown at 120, to facilitate assembly and passage of the piston body through spacer plate 66. In its initial position, the outer end of piston 94 does not project entirely through the spacer plate bore 90, so as not to interfere with the engagement of bayonet 46 in receiver 48, or the manual releasing of the bayonet from the receiver as previously described. However, upon the occurrence of a predetermined event, causing detonation of the explosive primer cartridge 104, the extremely high pressure gases thereby generated, acting in the confined chamber 98, impel piston 94 forwardly with tremendous force, the piston immediately engaging bayonet 46 and driving it outwardly, taking with it cover plate 52 which separates from receiver 48 by shearing the cover plate mounting screws 78. In this respect, it will be noted that piston 94 is axially offset toward the front of receiver 48, and is not centered relative to the cover plate mounting screws 78 of each pair thereof, whereby the forward-most mounting screws 78 will shear first, followed by shearing of the rearward-most mounting screws 78 which action is enhanced by the leverage of bayonet 46 which will initially engage the forward portion of the cover plate, directly ahead of piston 94, such that the end of bayonet 46 will tend to fulcrum against the rearward edge of spacer plate 66.

While the explosive force impels piston 94 with such force that shearing of the cover mounting screws 78, which are of small diameter relative to the helmet mounting screws 70, will inevitability occur, it is desirable to provide means facilitating shearing without adversely affecting the strength of the mounting screws for purposes of securing cover plate 52 in position on receiver 48 and in a manner such that the sheared ends of the mounting screws do not protrude from the receiver. This is accomplished by providing mounting screws 78 with reduced diameter portions 122, and the reduced diameter portions 122 are located lengthwise of mounting screws 78 so as to be positioned within the bores 82 of jaw members 50. This causes the shearing action to occur at the reduced diameter portions 122, well within the jaw member bores 82, whereby the rough ends of the sheared-off mounting screws remaining with receiver 48 are positioned within the jaw member profile. If they were to project from jaw members 50 after separation of the mounting screw heads and cover plate 52, there would be the danger of injury, or rupture of an inflated life vest or similar equipment.

The sensor circuit, indicated 115 in FIG. 6, contained within body 116 is one which is responsive to a predetermined event, for example, immersion in water, and typically is characterized by a charging circuit including a battery power source and firing capacitor (not shown) in a charging circuit which is completed, for example by immersion of sensors in water. The actuator body 64, which typically is of aluminium, can be one such sensor and the other sensor, indicated 117 in FIG. 6, can be carried by the circuit enclosing body 116 so as to sense the presence of a fluid medium surrounding the receiver 48. The firing capacitor is discharged through the primer cartridge 104 to detonate the same, such discharge occurring as determined by the control circuit. For example, it could occur upon immersion in water, in which event a circuit of the type shown in U.S. Pat. No. 4,024,440 could be used. The control curcuit also can incorporate a time delay circuit to permit the aviator to use the supply of air initially trapped in hose 28 upon immersion in water, and indeed the circuit can include an arrangement such that firing does not occur until the hemlet emerges from the water. Housing 116 can be secured to actuator body 64 by screws (not shown) or other suitable means.

Accordingly, it is seen that the instant invention fully accomplishes its intended objects, providing an automatic release mechanism operable to forcibly separate the mask connector bayonet from the helmet-mounted bayonet receiver, thereby insuring the separation of the mask from the face of the wearer. This is accomplished by the use of an explosive actuator, activated upon the occurrence of a pre-selected event such as immersion in water or emergence therefrom, and, when activated, driving the separating piston with tremendous force to shear the mounting screws 78, totally removing cover plate 52 and forcibly driving the bayonet 46 outwardly, beyond the plane or profile of jaw members 50, such that it is totally removed from the spatial relation therewith required for mounting engagement. This is accomplished without modification of the mask connecting harness and bayonet assembly, and using the standard bayonet receiving cover plate and jaw members, the automatic release mechanism having substantially the profile of a standard receiver and requiring only a relatively modest and totally acceptable increase in the height thereof on the helmet shell. The foregoing also is accomplished in a manner completely independent of the manual release mechanism associated with the receiver.

We claim:

1. Apparatus for automatically releasing a breathing mask from a protective head enclosing helmet sufficiently to enable the wearer to breathe freely of the mask upon the occurrence of a predetermined event, the mask and helmet having coacting means for releasably securing the former to the latter in a secured relationship and in a position of use against the face of the wearer and manual release means associated with the coacting means permitting the wearer to manually separate the mask from the secured relationship with the helmet and thereby release the mask from the helmet comprising:

(a) explosively actuated means operatively associated with said coacting means for effecting separation thereof and thereby releasing the mask from the helmet;

(b) means responsive to the occurrence of the predetermined event for activating said explosively actuated means, said explosively actuated means being operable independently of the manual release means so that separation of said coacting means is effected by the explosive force of the explosively actuated means without actuation of the manual release means; and (c) said activating means comprising sensing means responsive to the predetermined event and circuit means operatively connected to said sensing means and to said explosively actuated means for actuating same in response to the predetermined event being sensed by said sensing means.

2. The apparatus of claim 1 wherein said coacting means includes a bayonet attached to the mask and a bayonet receiver carried by the helmet, said explosively actuated means acting upon said bayonet to forcibly separate if from the receiver.

3. The apparatus of claim 2, wherein the mask is provided with two such bayonets attached to opposite sides thereof and the helmet carries a bayonet receiver on each of the opposite sides thereof, said releasing means being operable to separate only one such bayonet from its receiver and each of said bayonet receivers possessing relatively low and similarly-shaped profiles as the helmet is viewed frontally.

4. The apparatus of claim 1 wherein said sensing means comprises a pair of sensors responsive to the presence of a body of water and said circuit means operates to activate said explosively actuated means in response to said sensors being exposed to a body of water.

5. The apparatus of claim 1 wherein said coacting means includes a bayonet attached to the mask and a bayonet receiver carried by the helmet, the mask is provided with two such bayonets attached to opposite sides thereof and the helmet includes a shell and carries a bayonet receiver on each of the opposite sides of the shell, each bayonet receiver being relatively short as measured generally outwardly from the helmet shell so as to provide the receivers with a relatively low profile as the helmet is viewed frontally.

6. The apparatus of claim 5, wherein each receiver is of similar size and shape and said receivers are symmetrically arranged on opposite sides of the helmet shell.

7. The apparatus of claim 1 wherein said coacting means includes a bayonet attached to the mask and a bayonet receiver carried by the helmet and the explosively actuated means is mounted within the bayonet receiver so as to be carried by the helmet.

8. The apparatus of claim 8, wherein said coacting means includes a bayonet attached to the mask and a bayonet receiver carried by the helmet, said bayonet receiver includes an assembly of attached components adapted to cooperate with said bayonet for releasably securing the bayonet to the receiver and the explosive force of said explosive activated means acts upon said receiver in a manner detaching said receiving components from one another and thereby releasing the bayonet from the receiver.

9. The apparatus of claim 1 wherein said coacting means includes a bayonet attached to the mask and a bayonet receiver carried by the helmet, said bayonet receiver includes a plurality of components held together in an assembled relationship and adapted to cooperate with said bayonet for releasably securing the bayonet to the receiver and the explosive force of said explosively activated means acts upon said receiver in a manner forcing apart the assembly of receiver components and thereby destroying the bayonet-securing capacity of the bayonet receiver so that upon activation of said explosively actuated means, the bayonet is released from the helmet.

10. The apparatus of claim 1 wherein said explosively actuated means is adapted to separate said coacting means upon actuation in a manner positively ensuring the separation of the mask from the helmet.

11. Apparatus for automatically releasing a breathing mask from a protective head enclosing helmet sufficiently to enable the wearer to breathe freely of the mask upon the occurrence of a predetermined event, the mask and helmet having coacting means for releasably securing the former to the latter in a position of use against the face of the wearer, said coating means including a bayonet attached to the mask and a bayonet receiver carried by the helmet wherein said bayonet is movable lengthwise along a first axis into securing engagement with said receiver, comprising:

(a) explosively actuated means operatively associated with coacting means for separating the same and thereby releasing the mask from the helmet, said explosively actuated means acting upon said bayonet in a direction generally at a right angle to said first axis to forcibly separate said bayonet from said receiver; and (b) means responsive to the occurrence of the predetermined event for activating said explosively actuated means.

12. The apparatus of claim 11, wherein said receiver includes an actuator body, a pair of jaw members mounted on said body, and a cover plate over said jaw members and defining therewith a bayonet receiving channel, said bayonet having means releasably engaging said jaw members upon insertion of said bayonet in said channel along said first axis, and said explosively actuated means acting upon said bayonet in a manner forcibly separating both said cover plate and said bayonet from said receiver.

13. The apparatus of claim 12, wherein said actuator body has a bore opening at its outer end into said bayonet receiving channel, said explosively actuated means comprising a piston movable in said bore away from the inner end thereof against the bayonet secured in said channel, a chamber communicating with said bore between said inner end thereof and said piston, an explosive cartridge within said chamber, said cartridge being capable of generating an inertial shock wave acting against said piston with sufficient force to separate said bayonet and said cover plate from said receiver.

14. The apparatus of claim 13, wherein said bore is cylindrical, said piston including an enlarged head portion having a cylindrical section press fitted against the wall of said bore to provide an essentially gas tight chamber between said piston head portion and said inner bore end in communication with said cartridge chamber, said cylindrical section comprising a bearing guide for movement of said piston along the axis of said bore.

15. The apparatus of claim 14, together with a spacer plate beween said actuator body and said jaw members, said spacer plate having an opening therethrough concentric with said bore, the diameter of said opening being less than the diameter of said bore thereby providing a stop for said piston head portion.

16. The apparatus of claim 11, said cover plate being held in position by mounting screws extending through said jaw members into said actuator body, said mounting screws being configured so as to shear off within said jaw members when said cover plate is explosively separated from said receiver.

17. The apparatus of claim 12, said activating means including an actuating circuit contained within a housing secured to said actuator body, means connection said cartridge in electrically conductive relationship to said activating circuit.

18. The apparatus of claim 17, said activating means including a pair of sensors responsive to the predetermined event, said actuator body comprising one of said sensors, said housing being electrically non-conductive, the other of said sensors being carried by said housing.

19. Apparatus for automatically releasing a breathing mask from a protective head enclosing helmet sufficiently to enable the wearer to breathe freely of the mask upon the occurrence of a predetermined event, the mask and helmet having coating means for releasably securing the former to the latter in a secured relationship and in a position of use against the face of the wearer and manual release means associated with the coacting means permitting the wearer to manually separate the mask from the secured relationship with the helmet and thereby release the mask from the helmet, comprising:

(a) explosively actuated means operatively associated with said coacting means for effecting separation thereof and thereby releasing the mask from the helmet;

(b) means responsive to the ocurrence of the predetermined event for activating said explosively actuated means, said explosively actuated means being operable independently of the manual release means so that the separation of said coacting means is effected by the explosive force of the explosively actuated means without actuation of the manual release means; and (c) said explosively actuated means comprising an explosive shock type primer for generating high pressure gas when detonated and piston means positioned to act on said coacting means and to be driven by such high pressure gas so that upon occurrence of the predetermined event said primer is detonated to generate such gas with explosive force to impel said piston means to separate said coacting means and release the mask from the helmet.

20. The apparatus of claim 19, wherein said coacting means includes a bayonet attached to the mask and a bayonet receiver carried by the helmet, said piston means acting upon said bayonet to forcibly separate it from the receiver.

21. Apparatus for automatically releasing a breathing mask from a protective head enclosing helmet sufficiently to enable the wearer to breathe freely of the mask upon the occurrence of a predetermined event, the mask and helmet having coacting means for releasably securing the former to the latter in a position of use against the face of the wearer wherein said coacting means includes a bayonet attached to the mask and a bayonet receiver carried by the helmet and wherein said bayonet is movable lengthwise along a first axis into securing engagement with said receiver, comprising:

(a) explosively actuated means operatively associated with said coacting means for separating the same and thereby releasing the mask from the helmet; and (b) means responsive to the occurrence of the predetermined event for activating said explosively actuated means, said explosively actuating means including an explosive shock type primer for generating high pressure gas when detonated and piston means acting upon said bayonet in a direction at generally a right angle to said first axis to separate said bayonet from said receiver and to be driven by such high pressure gas so that upon occurrence of the predetermined event, said primer is detonated to generate such gas with explosive force to impel said piston means to separate said coacting means and release the mask from the helmet.

22. Apparatus for automatically releasing a breathing mask from a protective head enclosing helmet sufficiently to enable the wearer to breathe freely of the mask upon the occurrence of a predetermined event, the mask and helmet having coacting means for releasably securing the former to the latter in a position of use against the face of the wearer and having manually operated means operatively associated with coacting means for releasing the mask from the helmet, said coacting means including a bayonet attached to the mask and a bayonet receiver carried by the helmet, wherein said bayonet is movable lengthwise along a first axis into securing engagement with said receiver, said automatic releasing means comprising:

(a) separating means operatively associated with said coacting means and independent of said manually operated means for acting upon said bayonet in a direction at generally a right angle to said first axis to separate said bayonet from said receiver and thereby release the mask from the helmet; and (b) means responsive to the occurrence of the predetermined event for activating said separating means.

23. Apparatus for automatically releasing a breathing mask from a protective head enclosing helmet sufficiently to enable the wearer to breathe freely of the mask upon the occurrence of a predetermined event, the mask and helmet having coacting means for releasably securing the former to the latter in a position of use against the face of the wearer, said coacting means including an elongated connector attached to the mask and a receiver carried by the helmet, said connector being movable lengthwise along an axis into securing engagement with said receiver, said automatic releasing apparatus comprising:

(a) separating means operatively associated with said coacting means and including explosively actuated means, which explosively actuated means is adapted to act on said connector in a direction at generally a right angle to said axis for forcibly separating said connector from said receiver thereby releasing the mask from the helmet; and (b) means responsive to the occurrence of the predetermined event for activating said explosively actuated means of separating means.

24. For use with a breathing mask-type protective helmet arrangement of the type wherein a mask and a helmet have coacting means for releasably securing the former to the latter in a position of use against the face of the wearer including a bayonet attached to the mask and a bayonet receiver carried by the helmet, said bayonet being movable lengthwise relative to and along an axis into securing engagement with said bayonet receiver, an automatic mask release mechanism comprising:

(a) bayonet receiving means adapted for manually releasably engagement with a mask attaching bayonet;

(b) explosively actuated means operatively associated with said bayonet receiving means for acting upon the bayonet engaged with said bayonet receiving means in a manner forcibly separating the bayonet from said receiver, said explosively actuated means adapted to act upon said bayonet in a direction at generally a right angle to said axis to separate said bayonet from said receiver.

(c) means operatively connected to said explosive actuated means and responsive to a predetermined event for activating said explosively actuated means.

25. For use with a breathing mask-protective helmet arrangement of the type wherein a mask and a helmet have coacting means for releasably securing the former to the latter in a position of use against the face of the wearer including a bayonet attached to the mask and adapted to be movable into securing engagement with a bayonet receiver carried by the helmet, an automatic mask release mechanism comprising:

(a) bayonet receiving means adapted for manually releasable engagement with a mask attaching bayonet;

(b) explosively actuated means operatively associated with said bayonet receiving means for acting upon a bayonet engaged with said bayonet receiving means in a manner forcibly separating the bayonet from said receiver, said explosively actuated means including an actuator body associated with said receiving means, said actuator body having a bore opening at one end into a bayonet receiving channel, piston means movable in said bore away from the opposite end thereof against a bayonet in said channel, a chamber communicating with said bore between said opposite end thereof and said piston means, and an explosive cartridge within said chamber, said cartridge being capable of generating an inertial shock wave acting against said piston means with sufficient force to separate a bayonet in said channel from said receiver; and (c) means operatively connected to said explosively actuated means and responsive to a predetermined event for activating said explosively actuated means.

26. The apparatus of claim 25, wherein said bore is cylindrical, said piston means including an enlarged head portion having a cylindrical section press fitted against the wall of said bore to provide an essentially gas tight chamber between said piston head portion and said opposite bore end is communication with said cartridge chamber, said cylindrical section comprising a bearing guide for movement of said piston means along the axis of said bore.

27. The apparatus of claim 26, said bayonet receiving means including a pair of jaw members and a cover plate over said jaw members and defining therewith said bayonet receiving channel, said piston means being operable to drive a bayonet engaged in said channel against said cover plate with sufficient force to separate both of them from said receiver.

28. The apparatus of claim 27, together with a spacer plate between said actuator body and said jaw members, said spacer plate having an opening therethrough concentric with said bore, the diameter of said opening being less than the diameter of said bore thereby providing a stop for said piston head portion.

29. The apparatus of claim 27, said cover plate being held in position by mounting screws extending through said jaw members into said actuator body, said mounting screws being configured so as to shear off within said jaw members when said cover plate is explosively separated from said receiver.

30. The apparatus of claim 24, said activating means including an actuating circuit contained within a housing secured to said actuator body, means connecting said cartridge in electrically conductive relationship to said activating circuit, said activating means including a pair of sensors responsive to the predetermined event, said actuator body comprising one of said sensors, said housing being electrically non-conductive, the other of said sensors being carried by said housing.

* * * * *

UNITED STATES PATENT AND TRADEMARK OFFICE

CERTIFICATE OF CORRECTION

PATENT NO. : 4,803,980

DATED : February 14, 1989

INVENTOR(S) :

Donald E. Nowakowski and Carlton W. Naab

It is certified that error appears in the above-identified patent and that said Letters Patent is hereby corrected as shown below:

Claim 26, line 6, "is" should be --in--.

Signed and Sealed this

Seventh Day of November, 1989

*Attest:*

JEFFREY M. SAMUELS

*Attesting Officer*

*Acting Commissioner of Patents and Trademarks*